US012434132B2

(12) United States Patent
Chen

(10) Patent No.: US 12,434,132 B2
(45) Date of Patent: Oct. 7, 2025

(54) DETACHABLE SLIDING TOY

(71) Applicant: Weiyong Chen, Shantou (CN)

(72) Inventor: Weiyong Chen, Shantou (CN)

( * ) Notice: Subject to any disclaimer, the term of this patent is extended or adjusted under 35 U.S.C. 154(b) by 0 days.

(21) Appl. No.: 18/649,670

(22) Filed: Apr. 29, 2024

(65) Prior Publication Data

US 2024/0416219 A1 Dec. 19, 2024

(30) Foreign Application Priority Data

Jun. 14, 2023 (CN) ..... 202321515030.7

(51) Int. Cl.
*A63F 9/08* (2006.01)

(52) U.S. Cl.
CPC .... *A63F 9/0807* (2013.01); *A63F 2009/0892* (2013.01)

(58) Field of Classification Search
CPC ..... A63F 9/0807; A63F 2009/0892; A63F 9/0803
See application file for complete search history.

(56) References Cited

U.S. PATENT DOCUMENTS 1,975,667 A * 10/1934 Roberts ..... A63F 9/0807 273/157 R
4,412,681 A * 11/1983 Irwin ..... A63F 3/00634 273/153 S
4,470,601 A * 9/1984 Finn ..... A63F 9/0803 273/281
4,524,971 A * 6/1985 Sasso ..... A63F 9/0803 273/281
4,927,150 A * 5/1990 Monoyios ..... A63F 9/0807 273/153 S
5,205,557 A * 4/1993 Kuo ..... A63F 9/0078 273/281
5,427,379 A * 6/1995 Lee ..... A63F 9/0803 273/281
5,529,301 A * 6/1996 Feller ..... A63F 9/0807 273/153 S
5,558,336 A * 9/1996 Sapello ..... A63F 3/00634 273/281
5,687,970 A * 11/1997 Clark ..... A63F 3/00634 273/281

(Continued)

FOREIGN PATENT DOCUMENTS

DE 3242495 A1 * 5/1984
DE 9418860 U1 * 4/1995

(Continued)

*Primary Examiner* — Steven B Wong

(57) ABSTRACT

A detachable sliding toy is provided, which includes a main frame, a sliding rail base, and a slider assembly, wherein a centre of the main frame is formed an accommodating cavity, and an inner wall of the accommodating cavity is provided with first fixed parts; a shape of the sliding rail base is matched to the accommodating cavity, and the sliding rail base is provided with second fixed parts detachably connected to the first fixed parts; a plurality of sliding grooves are cross arranged on the sliding rail base; the slider assembly is covered and connected to the sliding rail base, including a plurality of sliding blocks. The sliding toy can be quickly disassembled by separating the main frame and the sliding rail base, and then separating the sliding rail base and the slider assembly, with low difficulty in disassembly and assembly.

9 Claims, 7 Drawing Sheets

(56) References Cited

U.S. PATENT DOCUMENTS

| | | | | |
|---|---|---|---|---|
| 11,235,228 | B2 * | 2/2022 | Sasdelli | A63F 3/00261 |
| 2004/0245721 | A1 * | 12/2004 | Vernon | A63F 9/0803<br>273/153 S |

FOREIGN PATENT DOCUMENTS

| | | | | |
|---|---|---|---|---|
| DE | 29823072 | U1 * | 3/1999 | A63F 9/0807 |
| GB | 245004 | A * | 12/1925 | A63F 9/0807 |
| KR | 200186417 | Y1 * | 6/2000 | A63F 9/0807 |
| KR | 20170100754 | A * | 9/2017 | A63F 9/08 |

* cited by examiner

DETACHABLE SLIDING TOY

CROSS-REFERENCE

This application claims to the benefit of priority from Chinese Application No. CN202321515030.7 with a filing date of Jun. 14, 2023. The content of the aforementioned applications, including any intervening amendments thereto, are incorporated herein by reference.

TECHNICAL FIELD

This disclosure relates to a technical field of toys, in particular to a detachable sliding toy.

BACKGROUND

Klotski puzzle is a common type of sliding toy, which is played by moving the internal sliding blocks to obtain the desired layout of the sliding blocks. The Chinese utility model CN202221579584.9 provides a sliding toy structural component, which is equipped with a placement chamber on the surface of a fixed plate, so that multiple sliding blocks are located within the placement chamber. The sliding blocks are connected to the upper surface of the placement chamber through the sliding structure. Although the structural components of the sliding toy can drive the sliding block game and also have the function of preventing the missing of the sliding blocks, there are certain drawbacks, that is, the overall structure of the sliding toy is fixed, and it is difficult to disassemble when the sliding block parts are damaged or need to be replaced by sliding block parts with other patterns, resulting in low replacement efficiency and weak practicality.

SUMMARY

The main objective of the disclosure is to provide a detachable sliding toy, which can effectively solve the technical problems raised in the prior art, that is, the overall structure of the sliding toy is fixed, and it is difficult to disassemble the sliding toy so that the replacement efficiency is low, and the practicality is weak.

In order to achieve the above objective, a detachable sliding toy is provided by the present disclosure, which includes a main frame, a sliding rail base, and a slider assembly, wherein a centre of the main frame is is formed an accommodating cavity, and an inner wall of the accommodating cavity is provided with a plurality of first fixed parts; a shape of the sliding rail base is matched to the accommodating cavity, and the sliding rail base is provided with second fixed parts detachably connected to the first fixed parts at positions corresponding to the first fixed parts; a plurality of sliding grooves are cross arranged on the sliding rail base, and two ends of each sliding groove are connected to the outside; the slider assembly is covered and connected to the sliding rail base, including a plurality of sliding blocks, wherein each slider includes a pillar and a panel, the pillar is movably connected to the plurality of sliding grooves, and the panel is moved parallel to the sliding rail base following with the pillar.

Preferably, the main frame includes a plurality of combination blocks connected end-to-end, each combination block is provided with a first connecting part and a second connecting part at both ends, the first connecting part is detachably connected to the second connecting part of another combination block, and at least one first fixed part is provided on an inner wall of each combination block.

Preferably, at least one of the plurality of combination blocks is provided with a recessed slot adjacent to the panel, a shape of the recessed slot is matched to the panel, a bottom wall of the recessed slot is provided with an extension slot at a position corresponding to the sliding groove, and the extension slot is connected to the sliding groove and is slidably connected to any of the pillars inside.

Preferably, the main frame further includes a flip cover, a shape of the flip cover is matched to the recessed slot, and the flip cover is detachably connected to the recessed slot.

Preferably, one side of the flip cover is rotationally connected to the recessed slot through a rotation block, the other side of the flip cover corresponding to the rotation block is provided with a fixed boss protruding towards a direction of the recessed slot, and the fixed boss is detachably matched with the recessed slot in a concave-convex fit.

Preferably, the sliding rail base includes a plurality of splicing blocks connected sequentially, any two adjacent splicing blocks are fixed through a first splicing part and a second splicing part, and the first splicing part and the second splicing part are detachable.

Preferably, the splicing blocks include two first splicing blocks located at an end, at least one second splicing block located in a middle; an outer side of the first splicing block is provided with a second fixed part, and an inner side of the first splicing block is provided with the first splicing part and/or the second splicing part; and opposite sides of the second splicing block are correspondingly provided with the first splicing part and/or the second splicing part.

Preferably, the first splicing part is set as a hollow convex column protruding outward, the second splicing part is set as a solid convex column that matches an inner diameter of the hollow convex column, and the solid convex column is detachably inserted and connected to the hollow convex column.

Preferably, the first connecting part is set as a T-shaped part, the second connecting part is set as a T-shaped edge matched to the T-shaped groove, and the T-shaped part is detachably buckled and connected to the T-shaped groove.

Preferably, the first fixed part is set as a narrow groove with a through opening, the second fixed part is set as a protrusion matched to the narrow groove, and the protrusion passes through the through opening and is detachably connected to the narrow groove.

Compared with the prior art, the advantages and positive effects of the present disclosure are as follows: the detachable sliding toy provided by the present disclosure is provided with a main frame that is hollowed in the middle, and a first fixed part is provided on the inner wall of the accommodating cavity of the main frame, so that the sliding rail base is matched and connected to the accommodating cavity, and a second fixed part is provided on the sliding rail base, so that the second fixed part and the first fixed part can be detachably connected to realize quick and convenient disassembly of the sliding rail base and the main frame. Further, by providing a plurality of sliding grooves on the sliding rail base that pass through at both ends, the slider assembly can be slidably connected to the sliding rail base through the through openings of the sliding grooves, so as to realize quick and convenient disassembly or connecting of the slider assembly and the sliding rail base. In summary, the sliding toy provided by this disclosure can be quickly disassembled and replaced by separating the main frame and the sliding rail base, and then separating the sliding rail base and the slider assembly when it is damaged, which is less difficult to disassemble and more efficient, and it can be conveniently replaced with slider assemblies of other patterns to provide players with a new gaming experience, which is of greater practicality.

Figure 1:
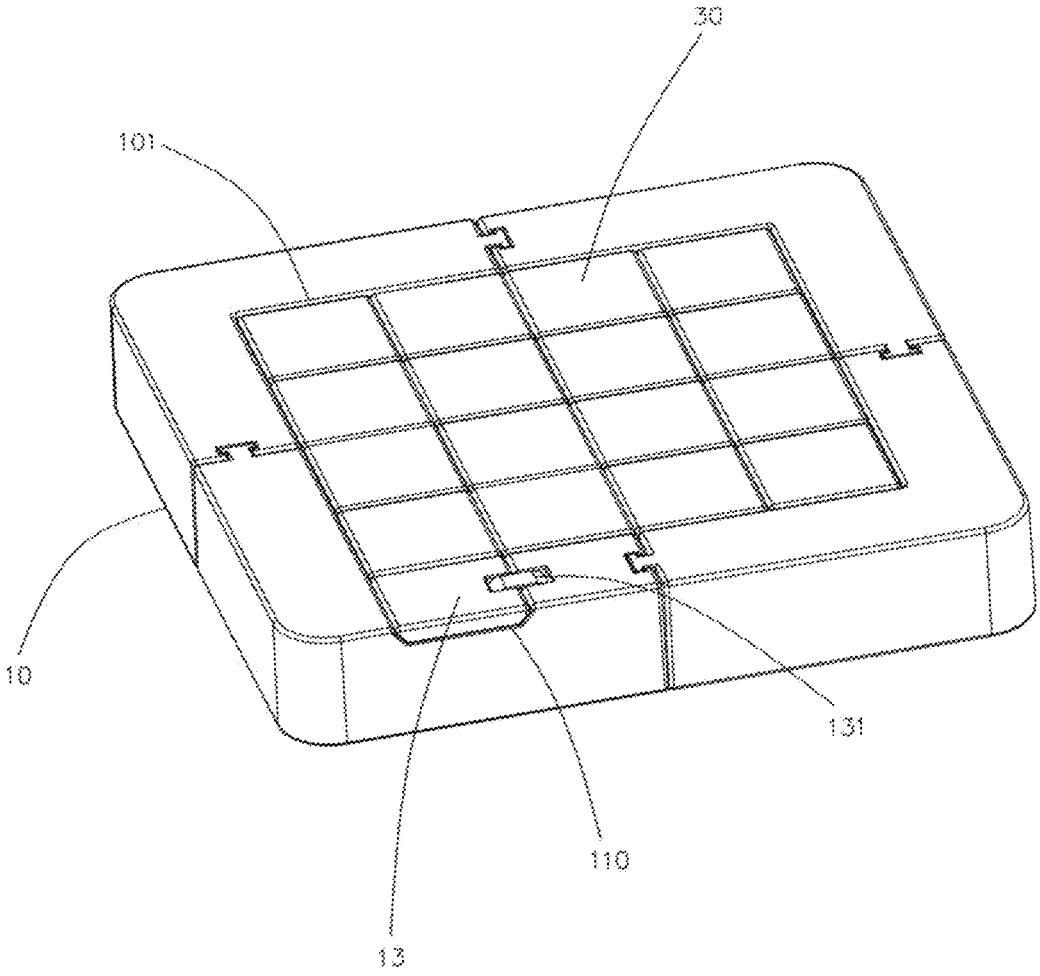
FIG. 1 is a schematic diagram of a sliding toy in the first embodiment of the present disclosure.
Figure 2:
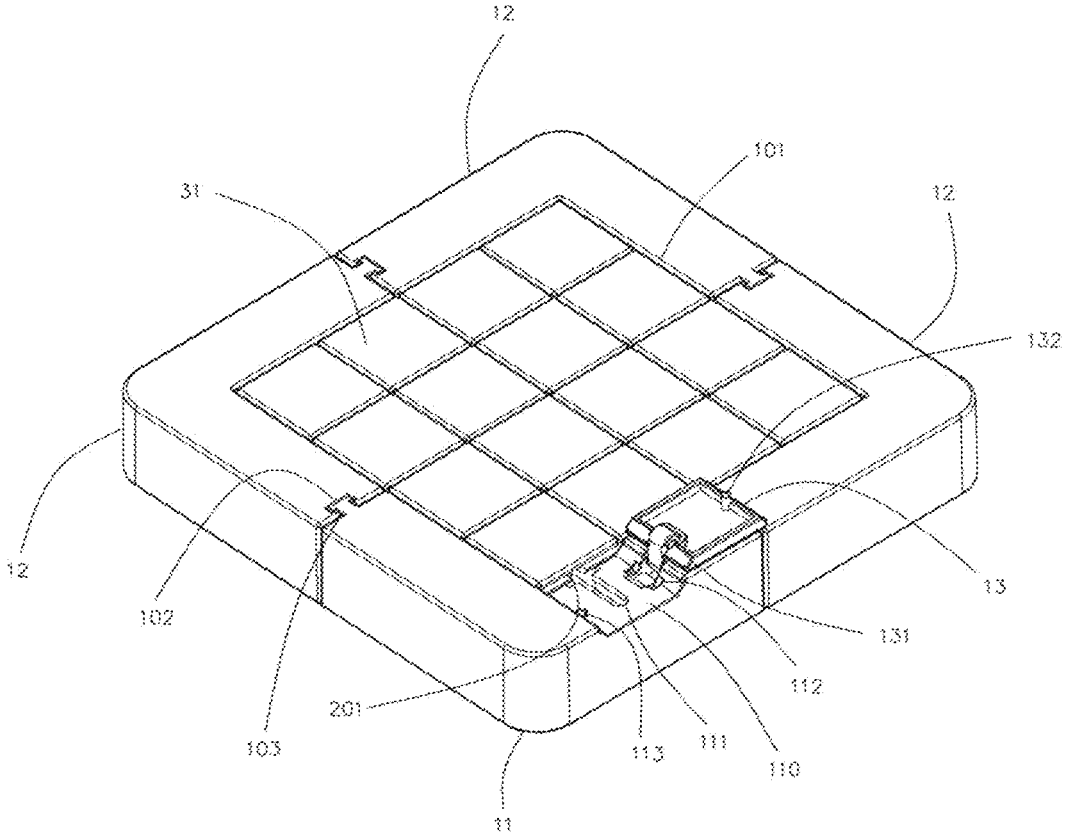
FIG. 2 is a schematic diagram of the use state of the sliding toy in FIG. 1.
Figure 3:
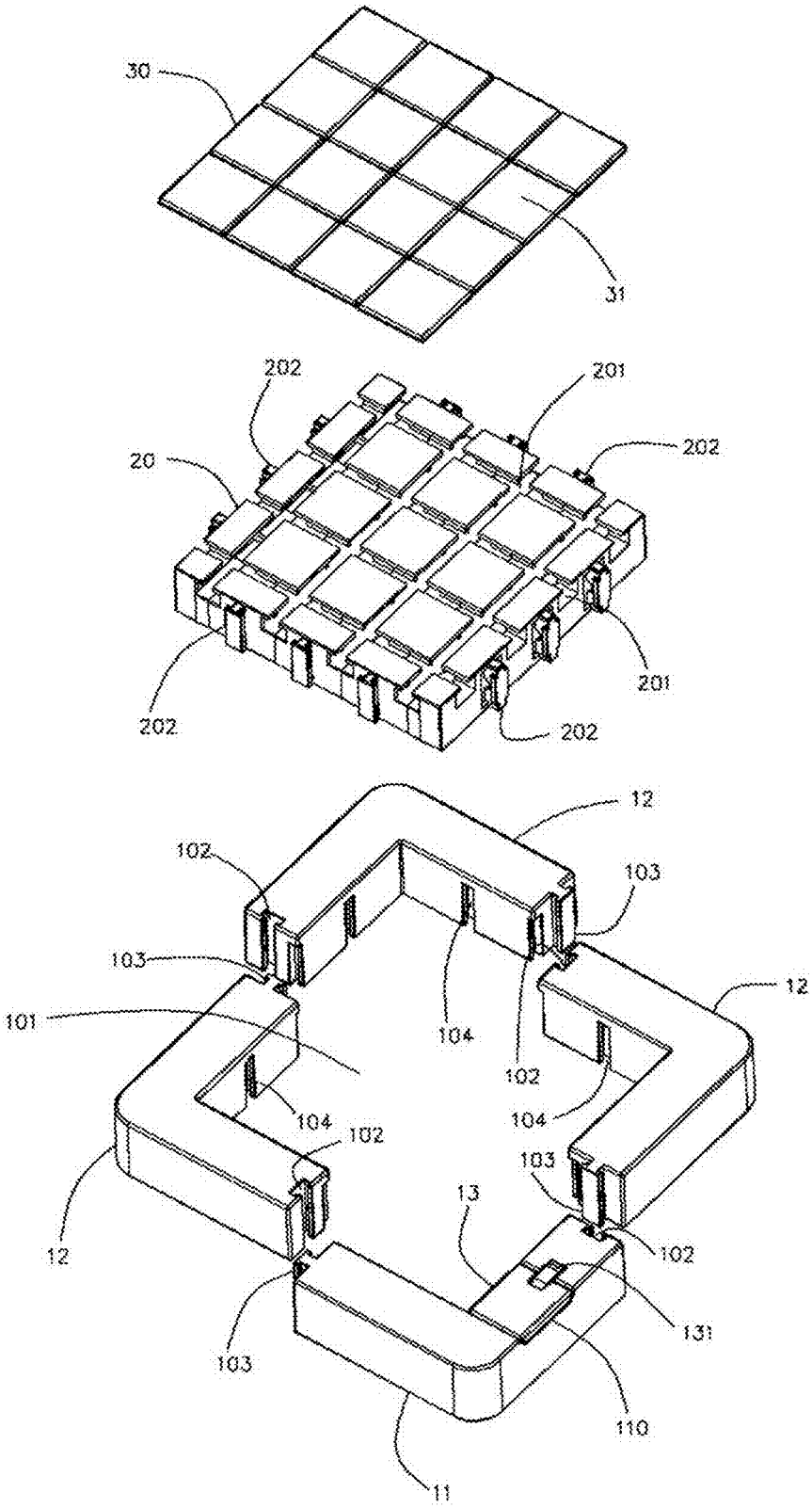
FIG. 3 is a schematic diagram of the disassembly state of the sliding toy in FIG. 1.
Figure 4:
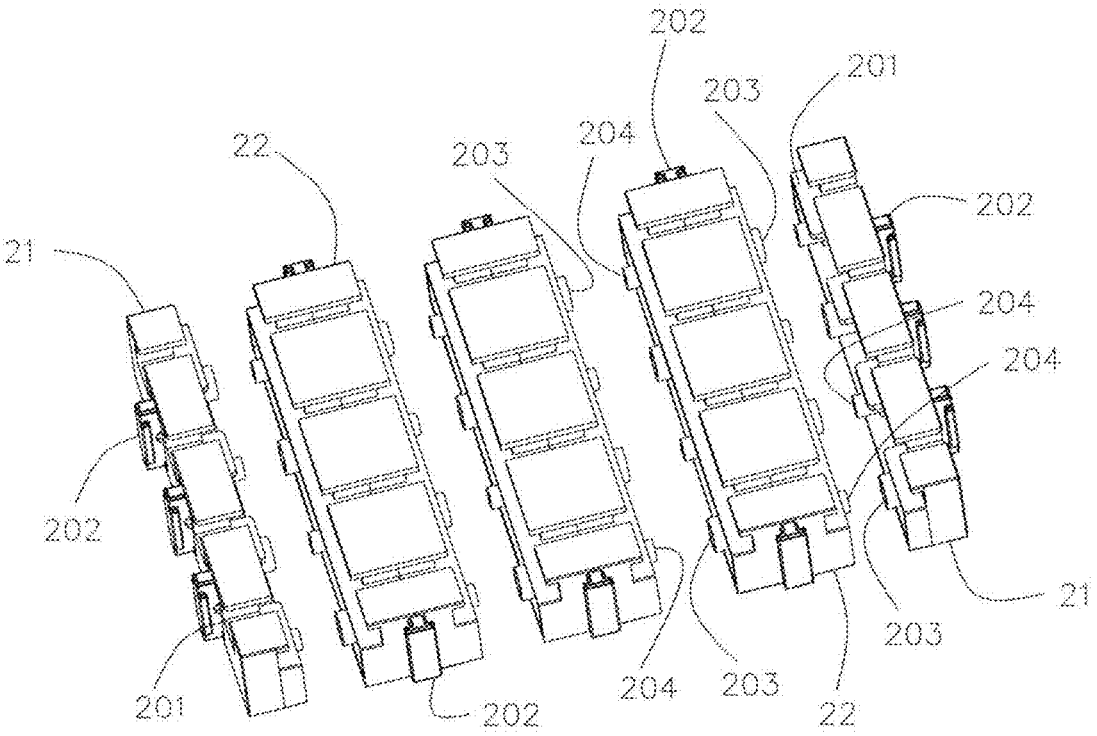
FIG. 4 is a schematic diagram of the disassembly state of the sliding rail base in FIG. 3.
Figure 5:
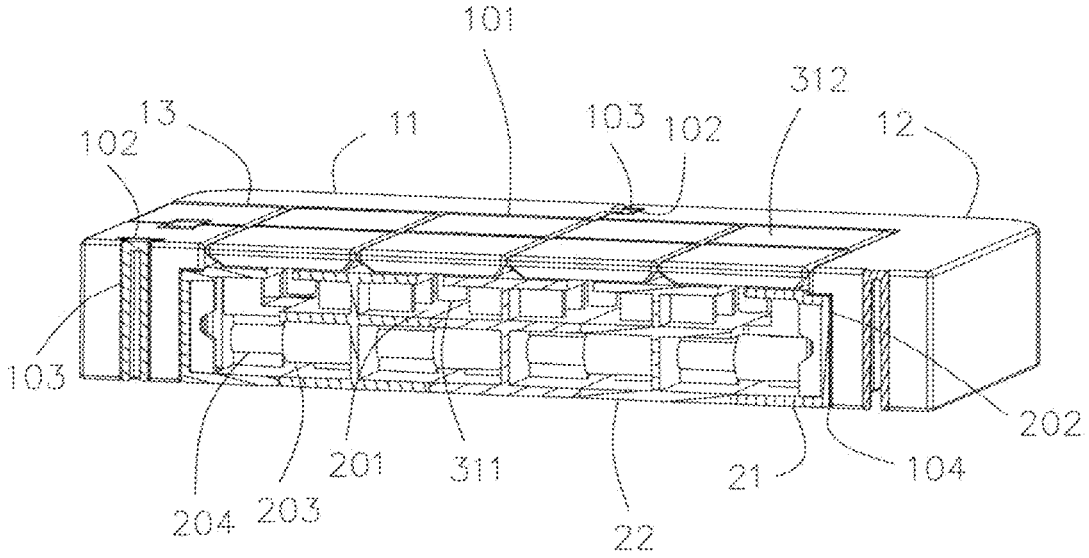
FIG. 5 is a sectional schematic diagram of the sliding toy in FIG. 1.

Reference numbers in the figure: 10—main frame; 101—accommodating cavity; 102—first connecting part; 103—second connecting part; 104—first fixed part; 11—first combination block; 110—recessed slot; 111—extension slot; 112—connection slot; 113—fixed slot; 12—second combination block; 13—flip cover; 131—rotation block; 132—fixed boss; 14—third combination block; 20—sliding rail base; 201—sliding groove; 202—second fixed part; 203—first splicing part; 204—second splicing part; 205—first assembly part; 206—second assembly part; 21—first splicing block; 22—second splicing block; 30—slider assembly; 31—sliding block; 311—pillar; 312—panel.

DETAILED DESCRIPTION OF THE EMBODIMENTS

Combined with the accompanying drawings, a further detailed illustration of the preferred embodiment of this disclosure will be provided as below.

The following describes in detail the embodiment of the present disclosure, the components of the embodiment are shown in the accompanying drawings by reference labels, wherein identical or similar labels throughout represent identical or similar components or components with identical or similar functions. The embodiment described below with reference to the accompanying drawings are exemplary and intended to illustrate the present disclosure, but cannot be understood as limitations to the present disclosure.

In the description of this disclosure, it should be understood that the terms "center", "longitudinal", "horizontal", "length", "width", "thickness", "up", "down", "front", "back", "left", "right", "vertical", "horizontal", "top", "bottom", "inside", "clockwise", and "counterclockwise", etc. indicate that the orientation or position relationship based on the orientation or position relationship shown in the drawings is only for the convenience of describing this disclosure and simplifying the description, rather than indicating or implying that the device or component referred to must have a specific orientation, be constructed and operated in a specific orientation. Thus, these terms cannot be understood as limitations to the present disclosure.

In addition, the terms "first", "second", etc. are only used to for descriptive purposes and cannot be understood as indicating or implying relative importance or implying the quantity of technical features indicated. Therefore, the features defined with the terms "first", "second", etc. may explicitly or implicitly include one or more of these features.

In this disclosure, unless otherwise specified and limited, the terms "installation", "connection", "connected", "fixation" and other terms should be broadly understood, for example, they can be fixed connections, detachable connections, or integrated connections; it can be a mechanical connection or an electrical connection; it can be directly connected, or indirectly connected through an intermediate medium, or it can be an internal connection between two components. For ordinary skilled person in the art, the specific meanings of the above terms in this disclosure can be understood based on specific circumstances.

In this disclosure, unless otherwise specified and limited, there may be direct contact between the first and second features, or indirect contact between the first and second features through other features between them when the first feature is "on" or "under" the second feature. Moreover, the first feature "above", "over", and "on" in the second feature include the first feature directly above and diagonally above the second feature, or simply indicating that the first feature is horizontally higher than the second feature. The first feature "below", "beneath", and "under" include the first feature directly below and diagonally below the second feature, or simply indicate that the horizontal height of the first feature is lower than that of the second feature.

Please refer to FIGS. 1 to 5, which illustrate a detachable sliding toy in the first embodiment of the present disclosure, including a main frame 10, a sliding rail base 20, and a slider assembly 30. The sliding rail base 20 is detachably connected to the main frame 10, and the slider assembly 30 is detachably connected to the sliding rail base 20 and connected within the main frame 10 along with the sliding rail base 20.

Wherein, the middle part of the main frame 10 is hollow to form an accommodating cavity 101, which allows the sliding rail base 20 to pass through one side of the opening of the accommodating cavity 101, and the sliding rail base 20 is matched and connected inside the accommodating cavity 101. In this embodiment, the main frame 10 is set as a square frame structure, and the accommodating cavity 101 is also a square cavity. The main frame 10 includes four components blocks connected end-to-end, wherein the two ends of each combination block are respectively provided with a first connecting part 102 and a second connecting part 103. The first connecting part 102 is detachably connected to the second connecting part 103 of the other combination block. That is to say, several detachable combination blocks are connected end-to-end to form a main frame 10. It should be noted that the structural composition of the main frame 10 is conducive to the quick and portable replacement of new components by disassembling and assembling the first connecting part 102 and the second connecting part 103 in case of local damage, thereby improving the overall service life of the sliding toy. Moreover, the structural composition of the main frame 10 can also increase or decrease the number and shape of the combination blocks according to consumer needs. The main frame 10 can be spliced into different sizes of squares or rectangles, so that the shape and size of the main frame 10 can be adjusted according to different consumer needs, improving the practicality of sliding toys.

In this embodiment, there are two first fixed parts 104 on the inner wall of each combination block. When several combination blocks are connected end-to-end to form the main frame 10, the first fixed part 104 is located on the inner wall of the accommodating cavity 101, which is detachably connected to the sliding rail base 20, thereby enabling the sliding rail base 20 to be detachably connected to the accommodating cavity 101. The first connecting part 102 is set as a T-shaped groove, and the second connecting part 103 is set as a T-shaped part matched to the T-shaped groove. The T-shaped part is detachably inserted and connected to the T-shaped groove. It can be understood that the setting of the T-shaped groove and T-shaped part allows any two adjacent combination blocks to be quickly disassembled or assembling by inserting and fastening, making the disassembly and assembly operation simple and portable, with low difficulty and high efficiency. In other embodiments of this disclosure, the number of first fixed parts 104 in each combination block can also be one, or three or more. The first connecting part 102 and the second connecting part 103 can also be arranged in other detachable structures, such as magnetic connection structures, concave-convex connection structures, buckle connection structures, bolt connection structures, etc.

In this embodiment, the four combination blocks are one first combination block 11 and three second combination blocks 12, respectively, wherein the first combination block 11 and the second combination block 12 are both arranged as equilateral right angle blocks. It can be understood that the first combination block 11 has a recessed slot 110 adjacent to the slider assembly 30, and the shape of the recessed slot 110 is matched to that of a slider assembly 30. The bottom wall of the recessed slot 110 is provided with an extension slot 111, and the extension slot 111 is connected to the sliding rail base 20 to allow the slider assembly 30 to move and be accommodated in the recessed slot 110. At this time, a gap is formed on the sliding rail base 20 to allow the slider assembly 30 to move on the sliding rail base 20. In other embodiments of this disclosure, the main frame 10 can also be set in other shapes, such as other polygons, toroidal shapes, pentagonal stars, or other irregular shapes. Each combination block can also be set in other shapes, such as straight bars, concave shape, etc. The shapes of several combination blocks can be exactly the same, partially the same, or different from each other. The number and shape of several combination blocks can be adjusted adaptively according to production processes and requirements. The recessed slot 110 is not limited to being set on the first combination block 11, and can also be set on any other combination block among several combination blocks.

In this embodiment, the main frame 10 further includes a flap cover 13, which has the same number as the number of recessed slots 110, and the shape of the flap cover 13 is matched to the recessed slots 110. The flap cover 13 can be detachably connected to the recessed slot 110 to open or close the recessed slot 110. One side of the flip cover 13 is rotationally connected to the recessed slot 110 through a rotation block 131. The other side of the flip cover 13 corresponding to the rotation block 131 is provided with a fixed boss 132 protruding towards the direction of the recessed slot 110, and the fixed boss 132 is detachably matched with the recessed slot 110 in a concave-convex fit. Due to the presence of a flip cover 13, a connection slot 112 is provided at the position corresponding to the rotation block 131, and the connection slot 112 is used to allow the rotation of the rotation block 131 and accommodate the rotation block 131. A fixed slot 113 is provided at the position corresponding to the fixed boss 132 in the recessed slot 110, and the fixed slot 113 is used for separable concave-convex fit with the fixed boss 132. When the fixed boss 132 is fixedly connected to the fixed slot 113, the flip cover 13 is fixedly connected to the recessed slot 110, at this time, the recessed slot 110 is in a closed state, which plays a dust-proof role and can also fill the gap formed by the recessed slot 110 on the first combination block 11, making the overall structure of the main frame 10 more complete and beautiful. When the fixed boss 132 is removed from the fixed slot 113, rotating the flip cover 13 can drive the flip cover 13 to rotate relative to each other through the rotation block 131, in order to open the recessed slot 110.

In other embodiments of this disclosure, the main frame 10 may not be equipped with a flip cover 13, and the recessed slot 110 is exposed on the main frame 10 under this condition. The flip cover 13 may not be equipped with a rotation block 131 and/or a fixed boss 132, and the recessed slot 110 may not be correspondingly equipped with a connection slot 112 and/or a fixed slot 113 under this condition.

The shape of the sliding rail base 20 is matched to the accommodating cavity 101, and there are several sliding grooves 201 cross set on one side of the accommodating cavity 101 on the sliding rail base 20. The two ends of each sliding groove 201 are connected to the outside, so that the slide assembly 30 can be conveniently and quickly disassembled or assembled on each sliding groove 201 through the opening of each sliding groove 201. It should be noted that one of the several sliding groove 201 is connected to the extension slot 111, so that a slider assembly 30 can be moved to the extension slot 111 through the sliding groove 201, and thus a slider assembly 30 can be moved and accommodated on the recessed slot 110. The thickness of the sliding rail base 20 is smaller than the thickness of the accommodating cavity 101, so that when the sliding rail base 20 is covered and connected with a slider assembly 30, the slider assembly 30 can also be accommodated and connected to the accommodating cavity 101, in order to limit the slider assembly 30 to the accommodating cavity 101 and prevent the slider assembly 30 from being lost.

The outer wall of the sliding rail base 20 is equipped with a second fixed part 202 that can be detachably connected to the first fixed part 104 at a position corresponding to the first fixed part 104, to achieve a detachable connection between the sliding rail base 20 and the main frame 10. In this embodiment, the first fixed part 104 is configured as a narrow groove with a through opening, so that the sliding rail base 20 can be matched and connected within the accommodating cavity 101 through the through opening. The second fixed part 202 is configured as a protrusion that is matched to the narrow groove, and the protrusion is detachably connected to the narrow groove through the through opening. It can be understood that the setting of the protrusion and the narrow groove allows the sliding rail base 20 and the main frame 10 to be quickly disassembled or installed through interlocking, making the disassembly and assembly operation simple, portable, easy to operate, and efficient. In other embodiments of this disclosure, the first fixed part 104 and the second fixed part 202 can also be set as other detachable structures, such as magnetic connection structures, concave-convex connection structures, buckle connection structures, bolt connection structures, etc.

In this embodiment, the sliding rail base 20 includes five sequentially connected splicing blocks, and any two adjacent splicing blocks are fixed by a detachable first splicing part 203 and a second splicing part 204. It can be understood that the splicing blocks include two first splicing blocks 21 located at the end and three second splicing blocks 22 located in the middle, wherein the first splicing block 21 and the second splicing block 22 are both set as rectangular bars. When the first splicing blocks 21 and the second splicing blocks 22 are sequentially connected, the sliding rail base 20 presents a square shape matched to the shape of the accommodating cavity 101. In other embodiments of this disclosure, the sliding rail base 20 may not be equipped with a second splicing block 22, or the number of second splicing blocks 22 in the sliding rail base 20 may be one, two, or four or more. Each splicing block can also be set in other shapes, such as triangular blocks, etc. The shapes of several splicing blocks can be exactly the same, partially the same, or different from each other. The number and shape settings of several splicing blocks can be adjusted adaptively according to production processes and needs.

It should be noted that the structural composition of the sliding rail base 20 is conducive to the quick and portable replacement of new components by disassembling and assembling the first splicing part 203 and the second splicing part 204 in case of local damage, thereby improving the overall service life of the sliding toy. Moreover, the structural composition of the sliding rail base 20 can increase or decrease the number and shape of the splicing blocks based on the shape and size of the accommodating cavity 101, which is used to enable the sliding rail base 20 to make adaptive adjustments according to the shape and size of the accommodating cavity 101, and to improve the practicality of the sliding toy in conjunction with the main frame 10.

In this embodiment, a second fixed part 202 is provided on the outer side of each first splicing block 21, and several first splicing parts 203 and second splicing parts 204 are spaced on the inner side of each first splicing block 21. On the opposite sides of each second splicing block 22 are provided with first splicing part 203 and second splicing part 204 respectively at the positions corresponding to first splicing part 203 and second splicing part 204 of the first splicing block 21. The first splicing part 203 is set as a hollow convex column protruding outward, and the second splicing part 204 is set as a solid convex column that matches the inner diameter of the hollow convex column. The solid convex column is detachably inserted and connected to the hollow convex column. It can be understood that the setting of the solid convex column and the hollow convex column allows any two adjacent splicing blocks 21 to be fixed by insertion, enabling quick disassembly or installation, making the disassembly and assembly operation simple, portable, with low difficulty and high efficiency. In other embodiments of this disclosure, the inner side of the first splicing block 21 can also be equipped with only the first splicing part 203 or the second splicing part 204. At this time, the two opposite sides of the second splicing block 22 can be correspondingly configured with one side being the first splicing part 203 and the other side being the second splicing part 204. The first splicing part 203 and the second splicing part 204 can also be set as other detachable structures, such as magnetic connection structures, concave-convex connection structures, buckle connection structures, bolt connection structures, etc.

The slider assembly 30 is covered and connected to the sliding rail base 20, wherein the slider assembly 30 includes a plurality of sliding blocks 31. Each sliding block 31 includes a pillar 311 and a panel 312. The pillar 311 is movably connected within the plurality of sliding grooves 201, and can be moved into the extension slot 111 through the sliding groove 201 when the recessed slot 110 is opened, so that any sliding block 31 can be moved and accommodated in the recessed slot 110. The panel 312 moves parallel to the sliding rail base 20 following with the pillar 311, and the outer surfaces of several panels 312 can be sprayed with at least one of the patterns, letters, numbers, text, or other symbols, allowing consumers to move and restore the disordered panels 312 according to a certain pattern for gaming. It should be noted that the pillar 311 can be fixed to the sliding groove 201 by connecting bolts, thereby further preventing the missing of the slider assembly 30. As the above structure adopts existing technology, it will not be described details for brevity.

It should be noted that the disassembly and assembly process of the sliding toy provided in this embodiment is roughly as follows: the first connecting part 102 and the second connecting part 103 of any two combination blocks are inserted and buckled together, so that the plurality of combination blocks are connected with each other end-to-end to form the main frame 10. At the same time, any two adjacent splicing blocks are fixed through the first splicing part 203 and the second splicing part 204 to form the sliding rail base 20, and then several sliding blocks 31 are connected to the sliding rail base 20 through the openings of any sliding groove 201. Finally, the second fixed part 202 on the sliding rail base 20 is aligned with the first fixed part 104 inside the accommodating cavity 101, pushing the sliding rail base 20 towards the accommodating cavity 101, so that the sliding rail base 20 can be inserted and buckled onto the inner wall of the accommodating cavity 101, thus achieving assembly. When disassembling, the user just need to reverse the above steps. The sliding toy needs to rotate the flip cover 13 to open the recessed slot 110 during gameplay, in order to add an empty space on the basis of the sliding rail base 20, so that several sliding blocks 31 can move and change positions, and then move and restore the disrupted sliding blocks 31 according to a certain pattern.

Figure 6:
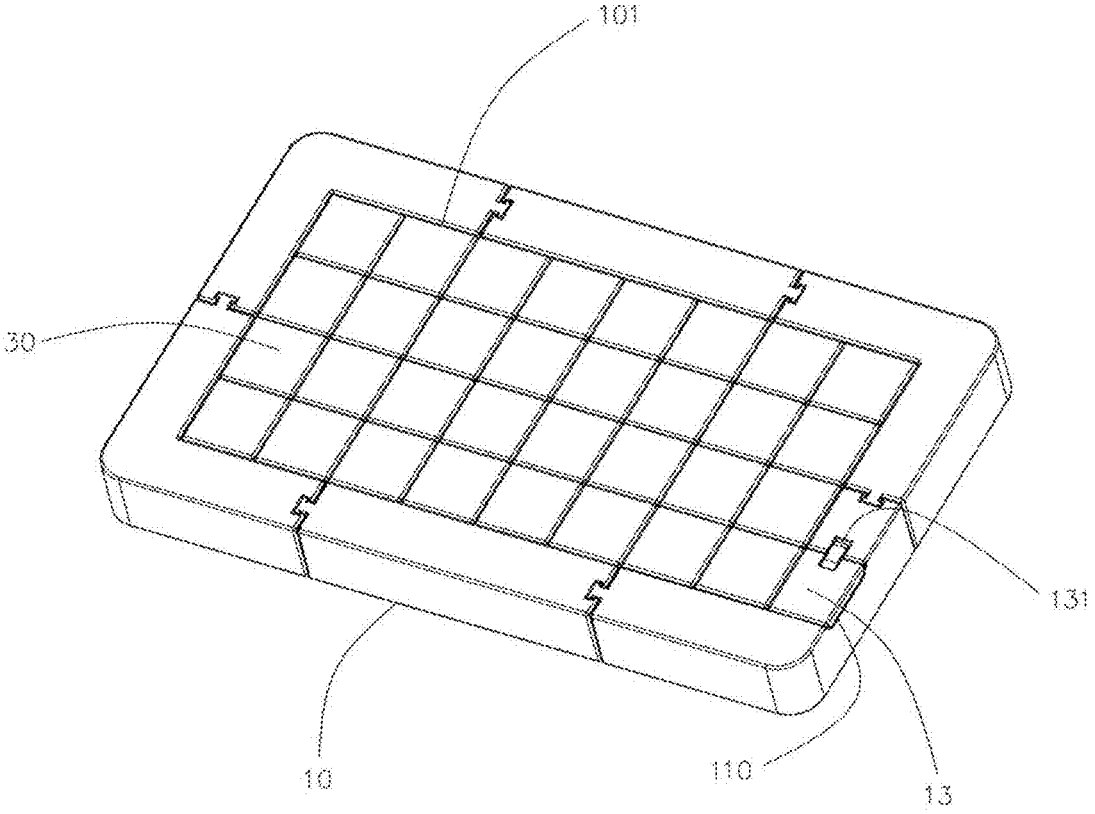
FIG. 6 is a schematic diagram of a sliding toy in the second embodiment of the present disclosure.
Figure 7:
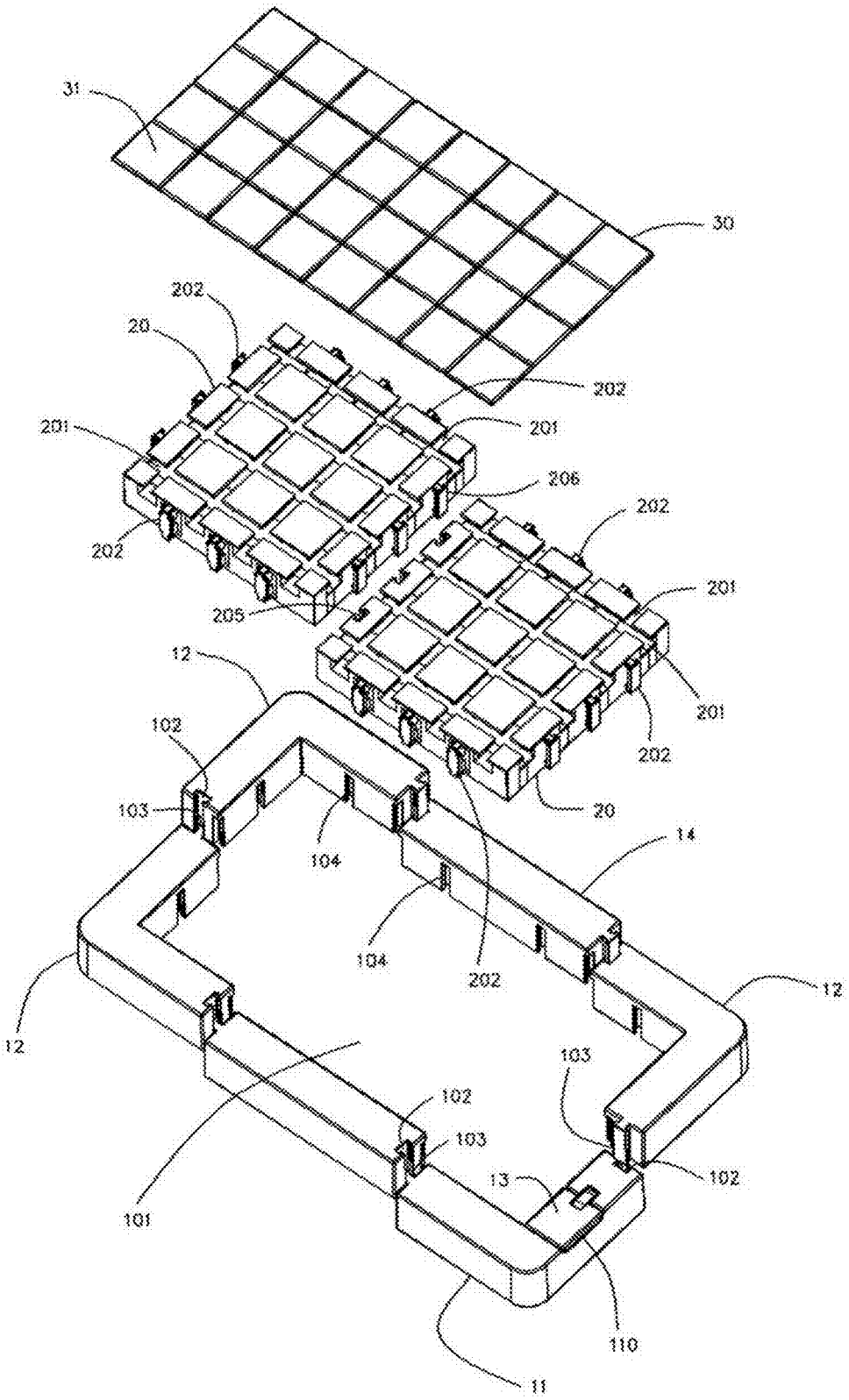
FIG. 7 is a schematic diagram of the disassembly of the sliding toy in FIG. 6.

Please also refer to FIG. 6-FIG. 7, which illustrate the detachable sliding toy in the second embodiment of the present disclosure. Unlike the first embodiment, in this embodiment, the main body frame 10 includes six combination blocks. The six combination blocks includes one first combination block 11, three second combination blocks 12, and two third combination blocks 14. The first combination block 11 and the second combination block 12 are both set as equilateral right angle blocks, while the third combination block 14 is set as a long bar block. The six combination blocks are connected end-to-end to form a rectangular frame structure. At this time, the accommodating cavity 101 is also a rectangular cavity. Obviously, in other embodiments, the shape and size of the main frame 10 can be changed by changing the number of the second combination blocks 12 and the third combination blocks 14.

In this embodiment, in order to enable the shape of the sliding rail base 20 to match and connect to the accommodating cavity 101, the sliding rail base 20 can be spliced into a rectangle shape by two square shaped sliding rail bases 20. Two square sliding rail bases 20 are respectively provided with a first assembly part 205 and a second assembly part 206 on the outer wall of the joint. In this embodiment, the first assembly part 205 is set as a T-shaped groove, the second assembly part 206 is set as a T-shaped part matched to the T-shaped groove, and the T-shaped part is detachably connected to the T-shaped groove. It can be understood that the setting of the T-shaped groove and T-shaped part allows the two square sliding rail bases 20 to be quickly disassembled or assembled by interlocking, making the disassembly and assembly operation simple and portable, with low difficulty and high efficiency.

In other embodiments of this disclosure, the first assembly part 205 and the second assembly part 206 can also be set as other detachable structures, such as magnetic connection structures, concave-convex connection structures, buckle connection structures, bolt connection structures, etc. The sliding rail base 20 can also be set as a single rectangular structure. When the shape and size of the accommodating cavity 101 change, multiple square sliding rail bases 20 can also be used to form a shape that is compatible with with the accommodating cavity 101 by splicing the first splicing part 205 and the second splicing part 206, or a single sliding rail base 20 can be set to a shape that is compatible with the accommodating cavity 101.

The above is only a preferred embodiment of the present disclosure and is not intended to limit it. For those skilled in the art, the present disclosure may have various modifications and variations. Any modifications, equivalent replacements. improvements, etc. made within the spirit and principles of this disclosure shall be included within the scope of this disclosure.

What is claimed is:

1. A detachable sliding toy, comprising a main frame, a sliding rail base, and a slider assembly, wherein a centre of the main frame is formed an accommodating cavity, and an inner wall of the accommodating cavity is provided with a plurality of first fixed parts; a shape of the sliding rail base is matched to the accommodating cavity, and the sliding rail base is provided with second fixed parts detachably connected to the first fixed parts at positions corresponding to the first fixed parts; a plurality of sliding grooves are cross arranged on the sliding rail base, and two ends of each sliding groove are connected to the outside; the slider assembly covers and is connected to the sliding rail base, and the slider assembly comprises a plurality of sliding blocks, wherein each sliding block comprises a pillar and a panel, the pillar is movably connected to the plurality of sliding grooves, and the panel is moved parallel to the sliding rail base following with the pillar;

the main frame comprises a plurality of combination blocks connected end-to-end, each combination block is provided with a first connecting part and a second connecting part at both ends, the first connecting part is detachably connected to the second connecting part of another combination block, and at least one first fixed part is provided on an inner wall of each combination block.

2. The detachable sliding toy as claimed in claim 1, wherein at least one of the plurality of combination blocks is provided with a recessed slot adjacent to the panel, a shape of the recessed slot is matched to the panel, a bottom wall of the recessed slot is provided with an extension slot at a position corresponding to the sliding groove, and the extension slot is connected to the sliding groove and is slidably connected to any of the pillars inside.

3. The detachable sliding toy as claimed in claim 2, wherein the main frame further comprises a flip cover, a shape of the flip cover is matched to the recessed slot, and the flip cover is detachably connected to the recessed slot.

4. The detachable sliding toy as claimed in claim 3, wherein one side of the flip cover is rotationally connected to the recessed slot through a rotation block, the other side of the flip cover corresponding to the rotation block is provided with a fixed boss protruding towards a direction of the recessed slot, and the fixed boss is detachably matched with the recessed slot in a concave-convex fit.

5. The detachable sliding toy as claimed in claim 1, wherein the sliding rail base comprises a plurality of splicing blocks connected sequentially, any two adjacent splicing blocks are fixed through a first splicing part and a second splicing part, and the first splicing part and the second splicing part are detachable.

6. The detachable sliding toy as claimed in claim 5, wherein the splicing blocks comprise two first splicing blocks located at an end, at least one second splicing block located in a middle; an outer side of the first splicing block is provided with a second fixed part, and an inner side of the first splicing block is provided with the first splicing part and/or the second splicing part; and opposite sides of the second splicing block are correspondingly provided with the first splicing part and/or the second splicing part.

7. The detachable sliding toy as claimed in claim 6, wherein the first splicing part is set as a hollow convex column protruding outward, the second splicing part is set as a solid convex column that matches an inner diameter of the hollow convex column, and the solid convex column is detachably inserted and connected to the hollow convex column.

8. The detachable sliding toy as claimed in claim 1, wherein the first connecting part is set as a T-shaped part, the second connecting part is set as a T-shaped edge matched to the T-shaped groove, and the T-shaped part is detachably buckled and connected to the T-shaped groove.

9. The detachable sliding toy as claimed in claim 1, wherein the first fixed part is set as a narrow groove with a through opening, the second fixed part is set as a protrusion matched to the narrow groove, and the protrusion passes through the through opening and is detachably connected to the narrow groove.

* * * * *